US006047433A

United States Patent [19]

Chang

[11] Patent Number: 6,047,433

[45] Date of Patent: Apr. 11, 2000

[54] BATH SCRUBBER

[76] Inventor: Che-Yuan Chang, No. 1, Lane 147, Sec. 2, Chung San Rd., Yun Lin, Chang Hua Hsien, Taiwan

[21] Appl. No.: 09/110,176

[22] Filed: Jul. 6, 1998

[51] Int. Cl.[7] ..... A47K 7/02

[52] U.S. Cl. ..... 15/222; 401/8; 601/137; 601/143

[58] Field of Search ..... 15/222; 401/8; 601/136–138, 143, 147

[56] References Cited

U.S. PATENT DOCUMENTS 5,504,963 4/1996 Bynum et al. ..... 15/222

5,736,213 4/1998 Meier ..... 15/222 X

FOREIGN PATENT DOCUMENTS 64-29241 1/1989 Japan ..... 15/222

*Primary Examiner*—Mark Spisich
*Attorney, Agent, or Firm*—Browdy and Neimark

[57] ABSTRACT

A bath scrubber is composed of a plurality of straps which are formed respectively of a plurality of cylindrical nets of a plastic material and are arranged side by side such that one end of each of the straps is fastened with a fastening piece, and that another end of each of the straps is fastened with another fastening piece. The two fastening pieces are respectively fastened with a grip.

3 Claims, 4 Drawing Sheets

BATH SCRUBBER

FIELD OF THE INVENTION

The present invention relates generally to a body cleaning article, and more particularly to a scrubber for use in cleaning one's body while taking a bath.

BACKGROUND OF THE INVENTION

As shown in FIGS. 1 and 2, a bath scrubber 1 of the prior art is made up of a plurality of elastic tubular nets 3 and two pull rings 4. The bath scrubber 1 has a scrubbing portion 2. The elastic tubular nets 3 are twisted to form the scrubbing portion 2.

Such a prior art bath scrubber as described above is defective in design in that the cleaning effect of the prior art bath scrubber 1 is not fully effective in light of the limited contact area between the skin and the elastic tubular nets 3, and that the twisted tubular nets 3 do not provide a user thereof with a comfortable touch.

SUMMARY OF THE INVENTION

The primary objective of the present invention is therefore to provide an improved bath scrubber free from the drawbacks of the prior art bath scrubber.

In keeping with the principle of the present invention, the foregoing objective of the present invention is attained by a bath scrubber consisting of a plurality of cylindrical nets of a plastic material. The cylindrical nets are arranged side by side such that both ends of each of the cylindrical nets are fastened with grips.

The foregoing objective, features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
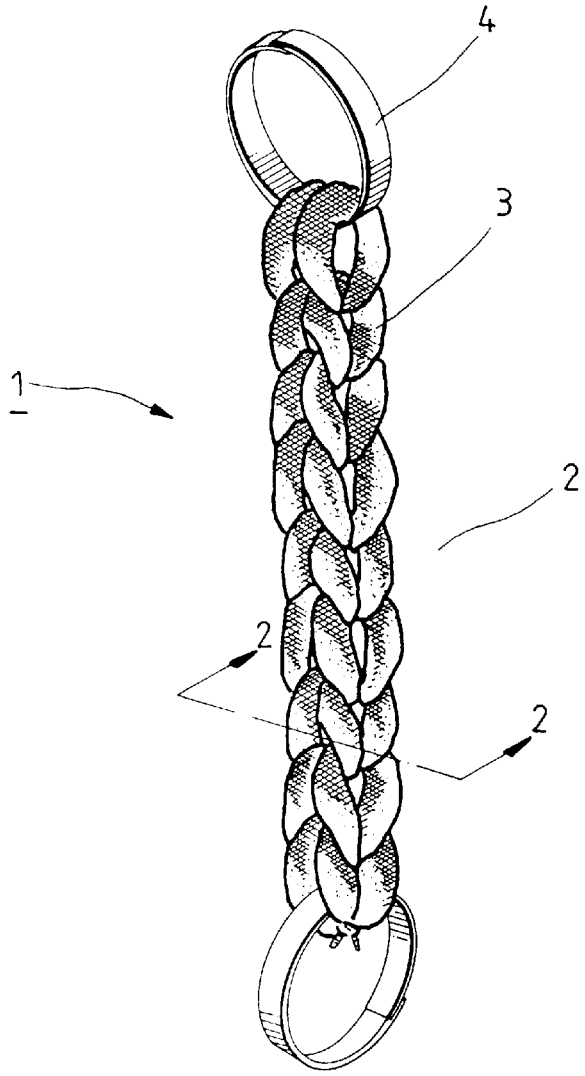
FIG. 1 PRIOR ART
FIG. 1 shows a perspective view of a bath scrubber of the prior art.
Figure 2:
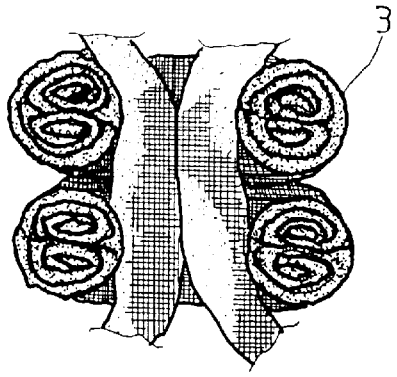
FIG. 2 PRIOR ART
FIG. 2 shows a sectional view of a portion taken along the direction indicated by a line 2—2 as shown in FIG. 1.
Figure 3:
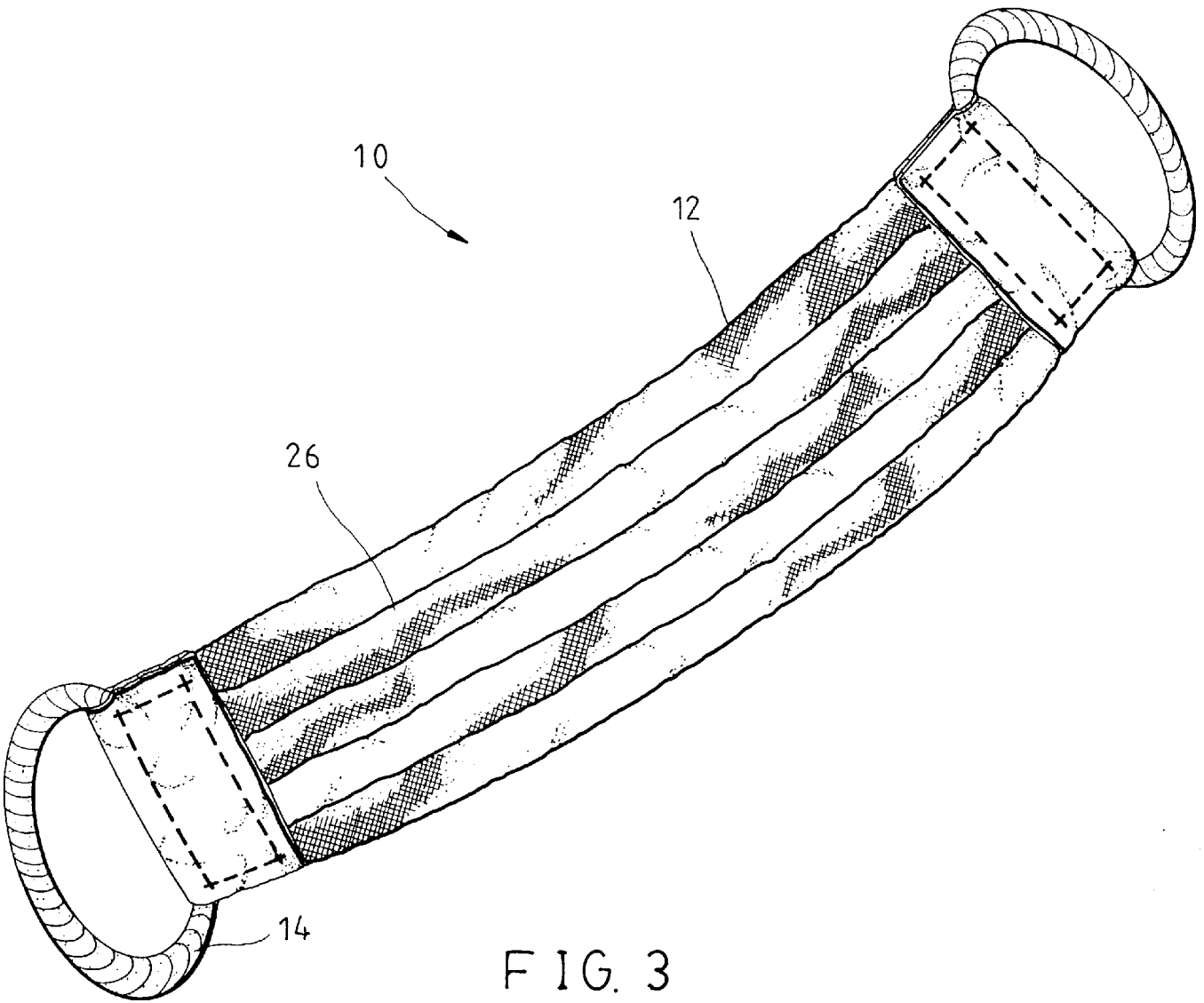
FIG. 3 shows a perspective view of a first preferred embodiment of the present invention.
Figure 4:
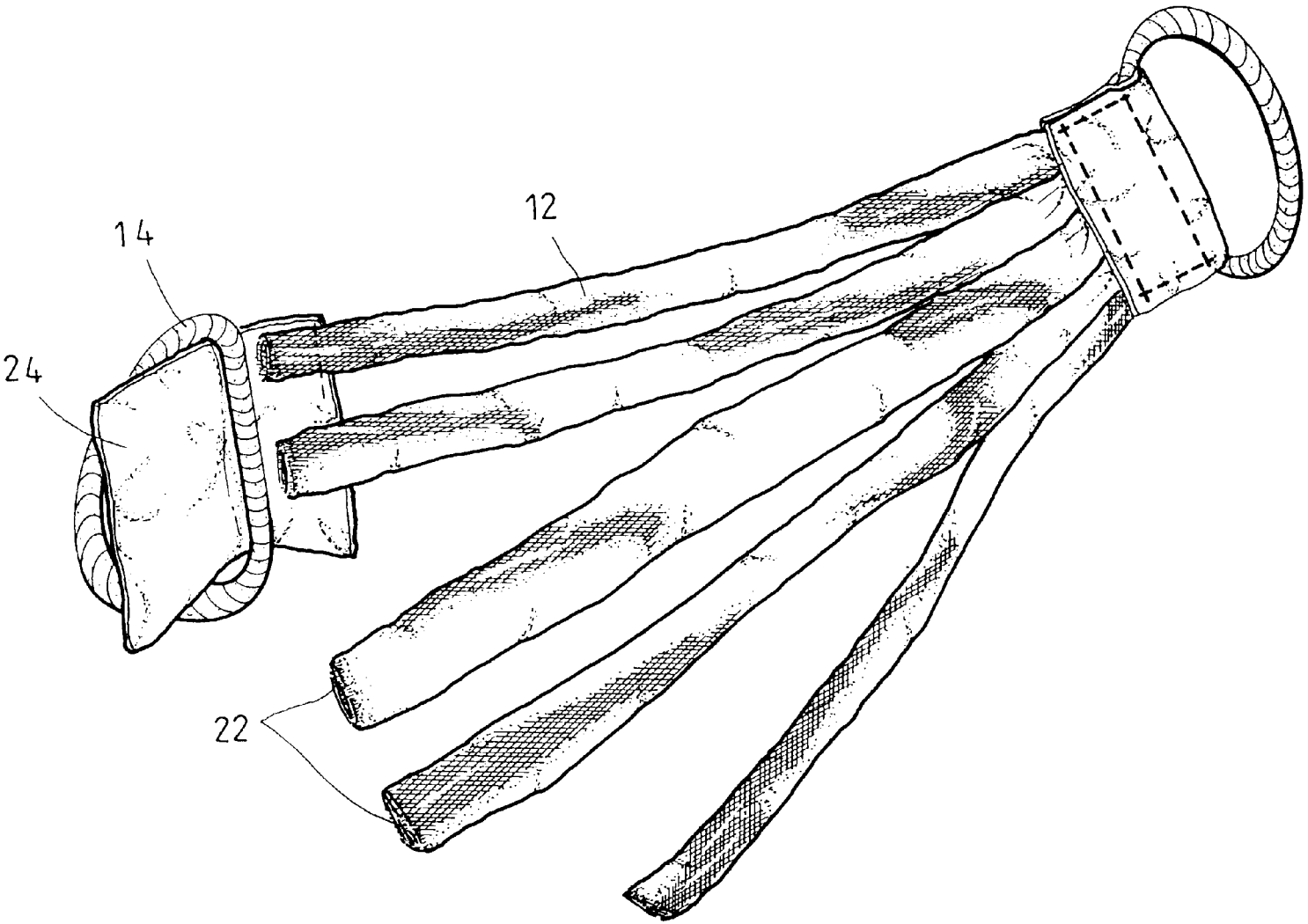
FIG. 4 shows a partial exploded view of the first preferred embodiment of the present invention.

As shown in FIGS. 3 and 4, a bath scrubber 10 of the first preferred embodiment of the present invention is composed of five straps 12, which are arranged side by side such that both ends of each of the five straps 12 are fastened with two fastening pieces 24 which are in turn fastened respectively with a grip 14. Each of the five straps 12 is formed of two elastic cylindrical nets 22 of a plastic material. The straps 12 may be fastened directly with the grips 14 by thermal welding or sewing.

The bath scrubber 10 of the present invention is provided with a relatively large contact surface 26 capable of enhancing the cleaning effect of the bath scrubber 10 of the present invention.

The straps 12 are joined together side by side by sewing such that both ends of the straps 12 are superimposed so as to make the contact surface 26 dense.

In light of the elastic cylindrical nets 22, the bath scrubber 10 of the present invention can be twisted to clean the hard-to-reach areas of the human body.

Figure 5:
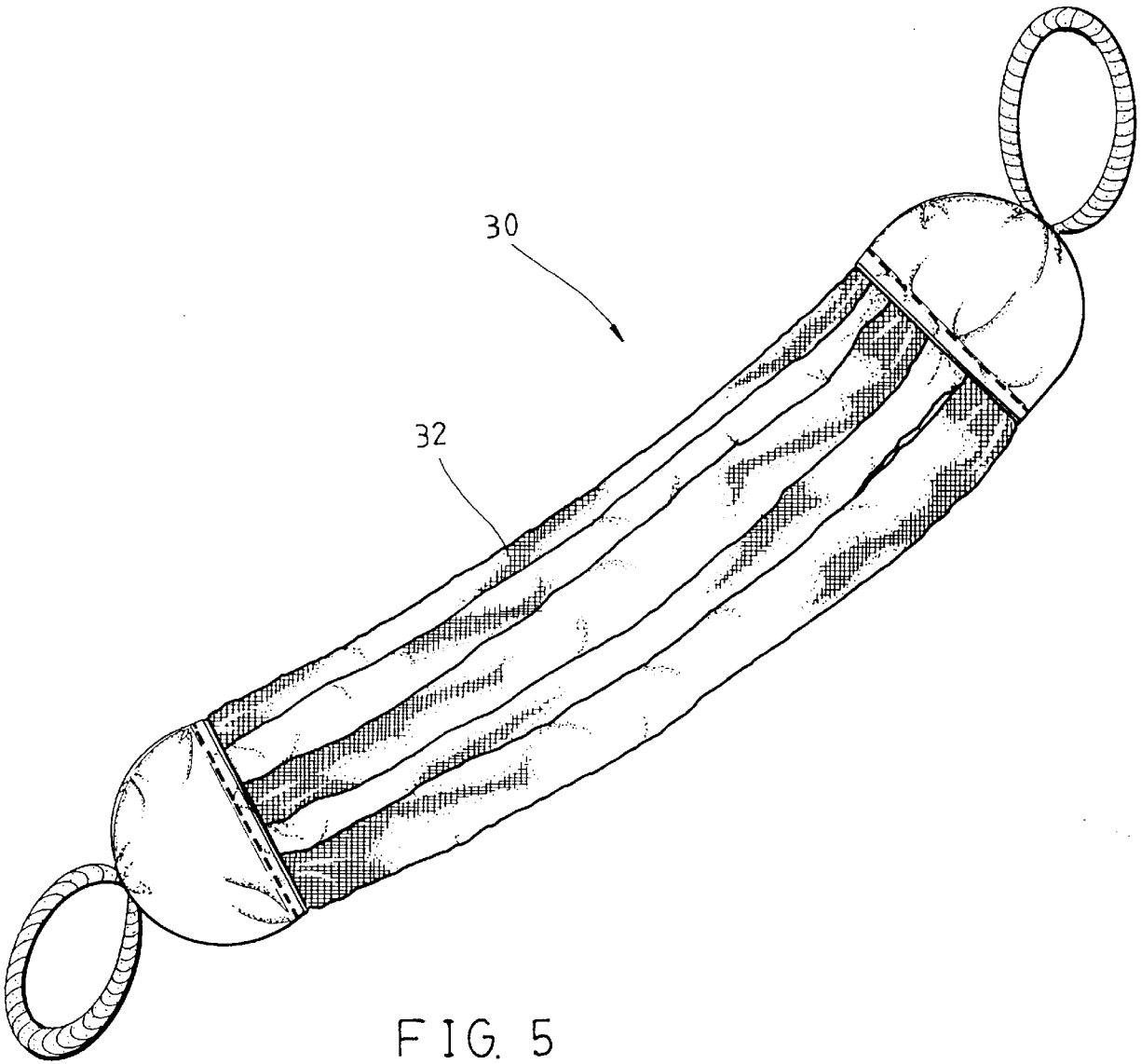
FIG. 5 shows a perspective view of a second preferred embodiment of the present invention.

As shown in FIG. 5, a bath scrubber 30 of the second preferred embodiment of the present invention is different from the bath scrubber 10 of the first preferred embodiment of the present invention in that the bath scrubber 30 is composed of a plurality of straps 32 which are respectively formed of different number of cylindrical nets (not shown in the drawing.) As a result, the straps 32 are different from one another in expansibility. In addition, the straps 32 are different in width so as to enable the bath scrubber 30 to give its user an added sense of touch.

What is claimed is:

1. A bath scrubber comprising a plurality of straps arranged side by side such that one end of each of said straps is fastened with a fastening piece, and that another end of each of said straps is fastened with another fastening piece, each of said straps being formed of a plurality of cylindrical nets of a plastic material;

wherein ends of said straps are fastened with said two fastening pieces such that ends of adjacent straps are superimposed.

2. The bath scrubber as defined in claim 1, wherein said fastening pieces are respectively fastened with a grip.

3. The bath scrubber as defined in claim 1, wherein ends of said straps are fastened directly with two grips by thermal welding or sewing.

* * * * *